US005435451A

United States Patent [19]

Dyer

[11] Patent Number: 5,435,451

[45] Date of Patent: Jul. 25, 1995

[54] BOTTLE FOR CONTAINING A FLUID

[75] Inventor: John J. Dyer, Shoreview, Minn.

[73] Assignee: Minnesota Mining and Manufacturing Company, St. Paul, Minn.

[21] Appl. No.: 49,844

[22] Filed: Apr. 20, 1993

[51] Int. Cl.[6] ..... B65D 23/00

[52] U.S. Cl. ..... 215/400; 220/755; 220/756; 220/771; 220/672; 220/675

[58] Field of Search ..... 215/1 C; 220/755, 756, 220/771, 669, 672, 675

[56] References Cited

U.S. PATENT DOCUMENTS

| | | | |
|---|---|---|---|
| D. 207,069 | 2/1967 | Stettler . | |
| D. 298,514 | 11/1988 | Dole et al. . | |
| D. 304,552 | 11/1989 | Lippman . | |
| D. 330,483 | 10/1992 | Plester et al. . | |
| D. 331,516 | 12/1992 | Waring . | |
| D. 341,775 | 11/1993 | Wolde et al. . | |
| D. 342,176 | 12/1993 | Steiner et al. . | |
| 1,265,381 | 5/1918 | Ramey . | |
| 3,225,950 | 12/1965 | Josephsen et al. | 215/1 C X |
| 3,536,500 | 10/1970 | Cleereman et al. | 215/1 C |
| 3,669,315 | 6/1972 | Kuckens . | |
| 4,113,129 | 9/1978 | Combio, Jr. | 215/1 C |
| 4,125,334 | 11/1978 | Jones . | |
| 4,328,909 | 5/1982 | Jeans . | |
| 4,344,459 | 8/1982 | Nelson . | |
| 4,408,701 | 11/1983 | Jeans . | |
| 4,421,804 | 12/1983 | Mori et al. | 215/1 C X |
| 4,457,343 | 7/1984 | Zukausky . | |
| 4,488,584 | 12/1984 | Hestehave et al. . | |
| 4,523,697 | 6/1985 | Jeans . | |
| 4,570,830 | 2/1986 | Jeans . | |
| 4,624,395 | 11/1986 | Baron et al. . | |
| 4,637,439 | 1/1987 | Jeans . | |
| 4,664,292 | 5/1987 | Jeans . | |
| 4,691,822 | 9/1987 | Malancon, Jr. . | |
| 4,805,793 | 2/1989 | Brandt et al. | 215/1 C X |
| 4,805,808 | 2/1989 | Larson . | |
| 4,865,211 | 9/1989 | Hollingsworth | 220/8 |
| 4,874,023 | 10/1989 | Ulm . | |
| 4,911,212 | 3/1990 | Burton . | |
| 4,993,565 | 2/1991 | Ota et al. . | |
| 5,042,698 | 8/1991 | Fessell . | |
| 5,067,622 | 11/1991 | Garver et al. | 215/1 C |
| 5,123,554 | 6/1992 | Arvidson et al. | 215/12.2 |
| 5,141,121 | 8/1992 | Brown et al. | 215/100 A |
| 5,147,615 | 9/1992 | Bird et al. . | |
| 5,222,615 | 6/1993 | Ota et al. | 215/1 C |
| 5,224,614 | 7/1993 | Bono et al. . | |

FOREIGN PATENT DOCUMENTS

| | | |
|---|---|---|
| 0356829A1 | 3/1986 | European Pat. Off. . |
| 2373486 | 12/1977 | France . |
| 797340 | 3/1957 | United Kingdom . |

OTHER PUBLICATIONS

PCT Search Report—PCT/US94/02066.

PCT Search Report—PCT/US94/01930.

*Primary Examiner*—Allan N. Shoap

*Assistant Examiner*—Stephen Cronin

*Attorney, Agent, or Firm*—Gary L. Griswold; Walter N. Kirn; Leland D. Schultz

[57] ABSTRACT

Disclosed is a bottle for containing a fluid and dispensing the fluid in conjunction with a fluid dispensing system. The bottle includes means to resist paneling during the dispensing of the fluid.

3 Claims, 2 Drawing Sheets

BOTTLE FOR CONTAINING A FLUID

FIELD OF THE INVENTION

This invention relates generally to bottle for containing a fluid, and more particularly, to bottles for containing and dispensing the fluids in conjunction with a dispensing system.

BACKGROUND OF THE INVENTION

Dispensing systems in the past have utilized bottles containing quantities of a fluid to be dispensed. In the gravity feed fluid dispensing systems to which the present invention is particularly directed, the bottles are stored in an upright position, then inverted for dispensing of the fluid from the bottle through the dispensing system.

It is important in many applications to accurately control the amount of the fluid that is dispensed. Frequently, such fluids are diluted prior to use, and it is desirable to accurately control the dilution rate, such of for reasons of economy or safety. This has been somewhat difficult to achieve with conventional bottle designs for dispensing systems.

An exemplar bottle is disclosed in U.S. Des. No. 298,514 entitled "Syrup Container or Similar Article". A bottle according to this design patent is available from Soda-Mate Enterprises of Trumbull, Conn. for use with its Model S100 gravity feed fluid dispenser system and has a capacity of 0.667 milliliters. Such bottles are injection/blow molded from a suitable polymeric material, such as high density polyethylene and typically have a wall thickness of 0.018 inches. Bottles of this type, although functional, are somewhat limiting during use since their limited capacity requires replacement or refilling at relatively frequent intervals.

Bottles having larger capacities may be employed. However, in conventional bottles having a larger capacity, the ratio of the wall thickness to the volume is reduced to the point where "paneling" occurs when the bottle is inverted and the fluid contained therein is being dispensed.

For purposes of this invention, the term "paneling" refers to inward and outward deflection in the walls of a bottle in a manner that induces fluctuations in the rate at which fluids are dispensed from a bottle. Paneling typically occurs with a bottle inverted and as the fluid is being dispensed. As the fluid level in the inverted bottle is reduced, a partial vacuum is gradually created in the "headspace" above the level of the fluid within the bottle. The walls of the bottle are gradually deflected inwardly under the influence of the partial vacuum. This deflection acts to enable the flow of the fluid from the bottle. The deflection increases until a point is reached where a quantity of the fluid has been dispensed from the bottle and the walls quickly flex outwardly, whereby the pressure in the head space is equalized with the ambient pressure.

The fluctuation of the flow of fluid from the bottle due to paneling prevents accurate metering of the dispensing of the fluid from the bottle. Furthermore, paneling may be exacerbated if the bottle is manually engaged and squeezed. Paneling is particularly a problem if the bottle is to be used in conjunction with a dispensing system for dispensing the fluid from the bottle in a controlled manner, and also to dilute the fluid with one or more other fluids.

Alternatively, the wall thickness of the larger capacity bottle may be increased to resist paneling. However, this may not be completely successful, and increases the weight and expense of the bottle.

Conventional dispensing systems and bottles for use therewith do not provide a bottle with adequate capacity that avoids the problem of paneling and subsequent inaccurate dispensing of fluids from the bottles.

SUMMARY OF THE INVENTION

Disclosed is a bottle for containing a fluid including a body having a cavity for receipt of a quantity of a fluid and an orifice communicating between the cavity and exteriorly of the bottle body. Means are provided to resist paneling when the bottle is in the inverted position and the fluid is being dispensed through the orifice. The bottle also includes a pair of spaced gripping surfaces adapted for manual engagement for manipulating the bottle between an upright position with the orifice directed upwardly, and an inverted position with the orifice directed downwardly.

In one embodiment of the invention, the means for resisting paneling includes a shoulder formed in the bottle body between each of the gripping surfaces and the orifice, wherein the shoulders stiffen the bottle body to resist paneling when the bottle body is inverted and the fluid is being dispensed.

The bottle may additionally include a plurality of ribs projecting from each of the gripping surfaces, to facilitate manual grasping and manipulation of the bottle.

BRIEF DESCRIPTION OF THE DRAWINGS

The present invention will be further described with reference to the accompanying drawing wherein like reference numerals refer to like parts in the several views, and wherein.

DETAILED DESCRIPTION OF THE INVENTION

Figure 1:
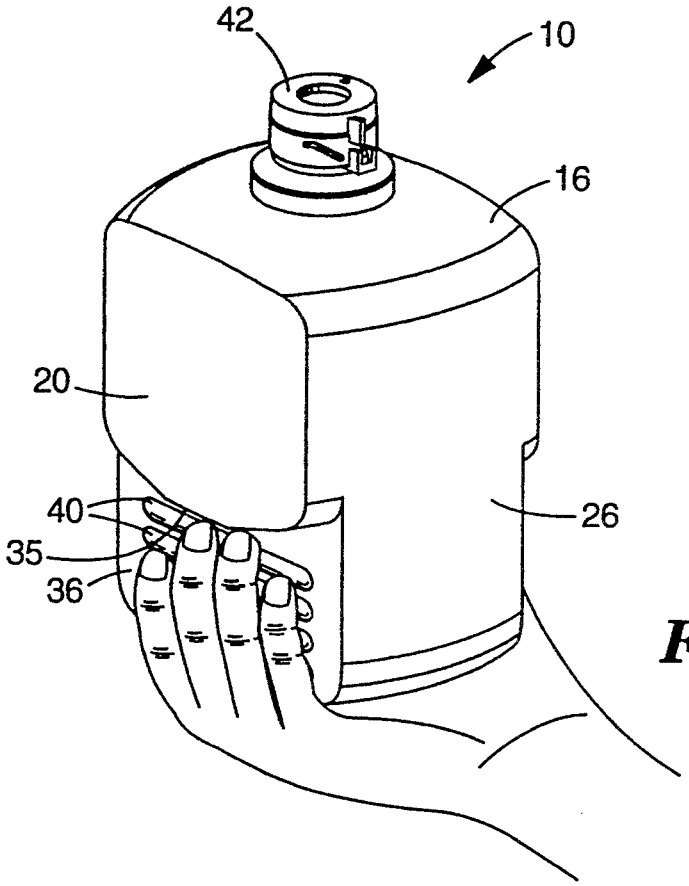
FIG. 1 is an isometric view of a bottle according to the present invention in an upright position and including a valve cap.
Figure 2:
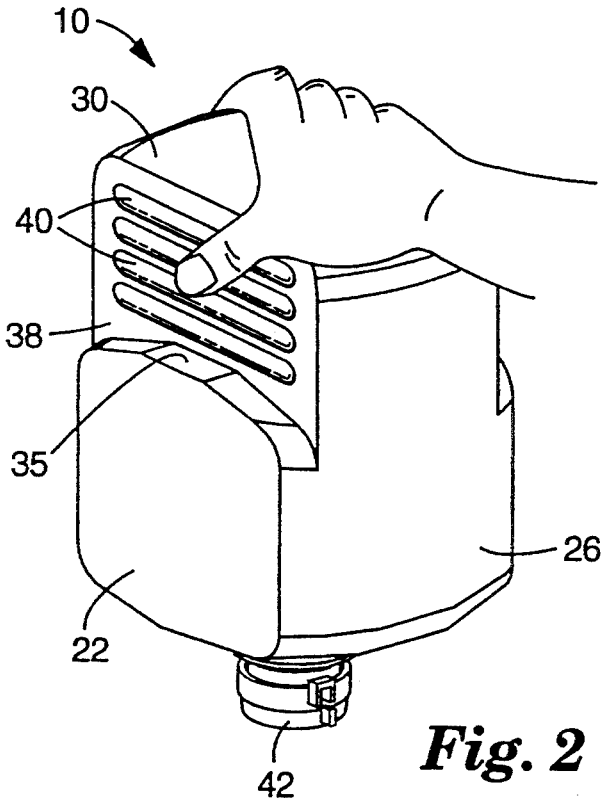
FIG. 2 is an isometric view of the bottle of FIG. 1 in an inverted position and including a valve cap.

Referring now to FIGS. 1–5, there is shown a bottle 10 according to the present invention. The bottle includes an orifice 12 in neck 14 on an upper side 16 communicating interiorly of the bottle for passage of fluid between the interior cavity 18 of the bottle and exteriorly of the bottle. Although the bottle may be constructed generally with any suitable configuration, such as cylindrical, in the illustrated embodiment of the invention, the bottle is generally rectangular in shape, including first and second sides 20, 22 and ends 24,26, as well as bottom 30.

Means are provided as part of this invention to resist paneling, as previously defined herein. By "resist", it is meant that paneling is reduced or eliminated when the bottle is inverted and the fluid is being dispensed. In the illustrated embodiment to the invention, the paneling control means takes the form of a shoulder 35 separating upper portions *20a,22a* of the first and second sides 20,22 from a pair of parallel, laterally spaced gripping surfaces 36,38. The upper portions 20*a*,22*a* are spaced from each other a greater distance than the spacing of the gripping surfaces 36,38. The shoulder 35, or any like sharp change in the shape or geometric configuration of the bottle, acts to strengthen the sides of the bottle to resist paneling. As can be seen from FIGS. 1,2 and 3, the shoulder need not be entirely linear (e.g. the middle portion is transverse, but opposite end portions are inclined upwardly), but extends in a generally transverse manner across the first and second sides between the gripping surfaces 36,38 and the orifice 14 of the bottle.

The degree of paneling resistance required is determined by the construction factors (including, but not limited to, material, wall thickness, and capacity) of the bottle. Thus, the wall thickness, weight and expense of the bottle 10 of the present invention may be reduced from what it might otherwise have to be in order to resist paneling. As previously discussed herein, conventional bottles for dispensing systems must either reduce the capacity of the bottle, or increase the wall thickness, and consequently the weight and expense of the bottle to avoid paneling, and even then may be not be completely successful in providing effective resistance to paneling.

Gripping surfaces 36,38 are adapted for manual engagement and manipulation of the bottle. As shown particularly in FIGS. 1 and 2, the gripping surfaces 36,38 facilitate the manual grasping and manipulation of the bottle 10. The bottle of the present invention may be used manually to dispense fluids, or may be employed with other types of dispensing systems, such as positive displacement systems or venturi effect fluid dispensing systems. In the preferred embodiment of the invention, the bottle is employed in conjunction with the dispensing system described and claimed in co-pending United States patent application entitled "Gravity Feed Fluid Dispensing System", filed of even date herewith, the contents of which are incorporated herein by reference.

Figure 3:
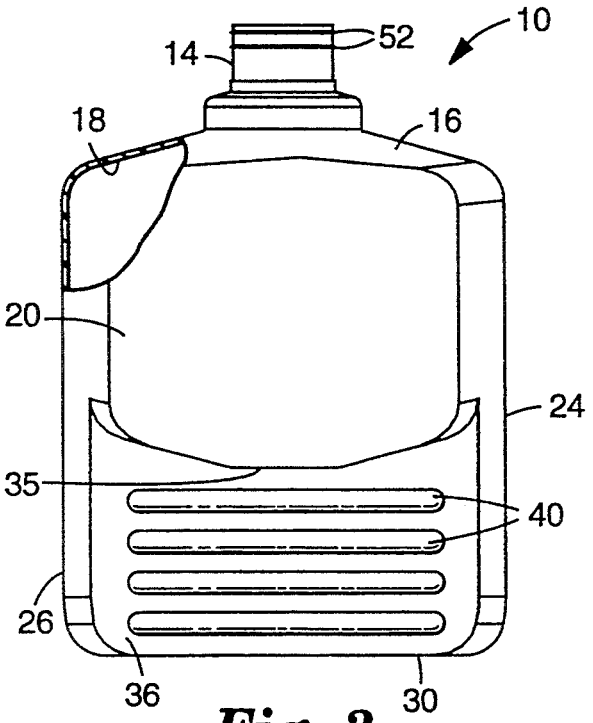
FIG. 3 is a front view of the bottle of FIG. 1 without a valve cap in an upright position.
Figure 4:
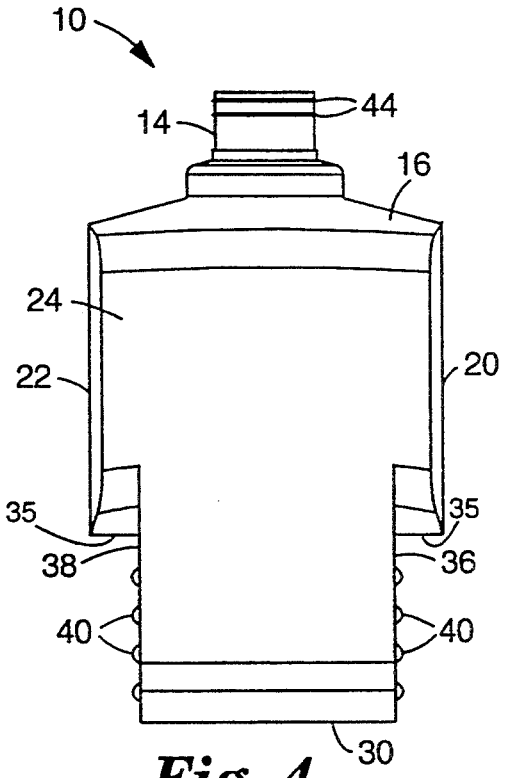
FIG. 4 is a side view of the bottle of FIG. 1 without a valve cap.
Figure 5:
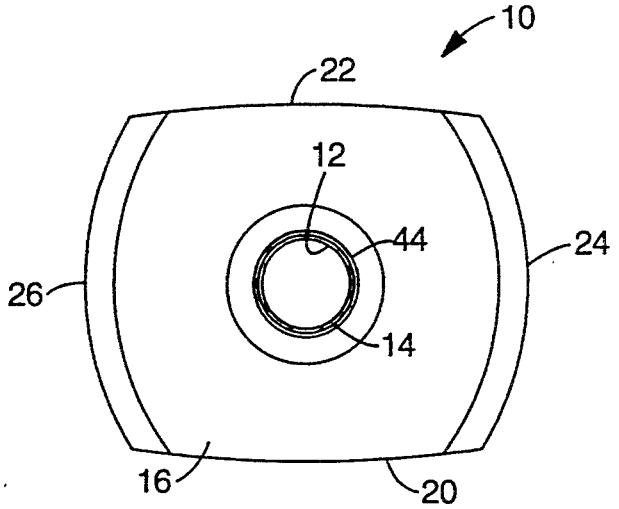
FIG. 5 is a top view of the bottle of FIG. 1 without a valve cap.

Most conveniently, the gripping surfaces 36,38 include a plurality of parallel, transverse ribs 40, as shown particularly in FIGS. 3 and 4. The ribs 40 are sized, constructed and located in a manner to most advantageously enhance the ability to manually grasp the bottle to perform the inversion (as shown in sequence in FIGS. 1 and 2) and installation of the bottle with respect to a dispensing system. Alternatively, the surface of the gripping surfaces 36,38 may be otherwise adapted to enhance the grasping of the bottle, such as by knurling or roughening of the surface.

It will be understood that the ribs 40 may also be constructed in a manner that assists shoulder 35 in resisting paneling in the gripping surfaces 36,38, and thus form part of the means to resist paneling. Such resistance to paneling would be exhibited if, for instance, the ribs were formed on the inner side of the gripping surfaces (e.g. within cavity 18) and other means were provided on the exterior surface of the gripping surface to enhance manual engagement and manipulation of the bottle, as previously described herein. The means for resisting paneling, which most preferably includes ribs 40, thus acts to resist the paneling that occurs when the bottle is squeezed while being manually grasped, such as to invert the bottle or to engage the bottle with a dispensing system.

The bottle 10 of the present invention may be constructed in any suitable manner and of any suitable material, but is most advantageously constructed of a polymeric material, such as high density polyethylene, low density polyethylene, polyethylene, polyvinyl chloride, polystyrene or the like. It will be recognized that the material selected to construct the bottle must be compatible with the fluid to the bottle is to receive and dispense. Preferably, the bottle is a unitary molded body, formed such as by blow molding, injection molding, or injection/blow molding, or any other suitable process known in the art.

By way of an example, the conventional SodaMate brand bottle for use with the Model S100 fluid dispensing system previously described herein has a capacity of 0.667 liters, is made of high density polyethylene and has a wall thickness of 0.018 inches. A bottle according to the present invention made of high density polyethylene may be constructed having a capacity of 2.0 liters with a wall thickness of between 0.018 inches and 0.26 inches. It is believed that a conventional bottle having a 2.0 liter capacity made of high density polyethylene would require a wall thickness of at least 0.040 inches to be useable and even then may not be as resistant to paneling as the bottle of the present invention.

The bottle of the present invention is designed for use in conjunction with a device for controlling the flow of fluid through the orifice, such as valve cap 42. The valve cap 42 may be secured in a fluid tight manner to the bottle by a snap closure that includes annular rings 44 in a manner known in the art. Alternatively, the valve cap 42 may threadedly secured to the bottle, or by any other suitable fluid tight arrangement.

Valve cap 42 may be of any suitable design, but is preferably as disclosed in U.S. Pat. No. 4,408,701, entitled "Liquid Dispensing Valve", the contents of which are incorporated herein by reference. Such caps include one portion mounted on the bottle over the orifice and another portion rotatably mounted on the first portion. The valve cap is shiftable between open and closed position for dispensing fluid by relative rotation of the first and second portions. Preferably, the valve cap is constructed in a manner so as to meter the flow of fluid from the bottle.

The present invention has now been described with reference to multiple embodiments thereof. It will be apparent to those skilled in the art that many changes can be made in the embodiments described without departing from the scope of the present invention. For instance, as is disclosed in the co-pending United States patent application entitled "Gravity Feed Fluid Dispensing System", filed of even date herewith, the bottle of the present invention may include a camming collar (not shown herein) integrally formed therewith in order to actuate the dispensing system, when the bottle is engaged therewith. Further, although a shoulder 35 is illustrated as being formed being both of the gripping surfaces and the orifice, it is within the spirit and scope of the present invention to provide a bottle with a shoulder formed between only one of the gripping surfaces and the orifice. Thus, the scope of the present invention should not be limited to the structures described in this application, but only by structures described by the language of the claims and the equivalents of those structures.

What is claimed:

1. A bottle for use in dispensing a fluid with a fluid dispensing system, comprising:

a generally rectangular bottle body having parallel first and second sides, parallel ends, each extending between said first and second sides, a top side and a bottom side, said first and second sides, said ends, and said top and said bottom enclosing a cavity in said bottle body adapted for receipt of a quantity of the fluid, an orifice formed in said top side for communicating between said cavity and exteriorly of the bottle body, a pair of spaced, generally planar parallel gripping surfaces formed in said first and second sides adjacent said bottom side for manual engagement from said bottom side for manipulating the bottle between an upright position with said orifice directed upwardly, and an inverted position with said orifice directed downwardly, further including a plurality of parallel transverse ribs projecting from each of said gripping surfaces, to facilitate manual engagement of said bottle body from said bottom side when shifting the bottle between said upright position and said inverted position, and wherein said ribs resist paneling in said gripping surfaces when said bottle is inverted and the fluid is being dispensed, and a shoulder formed in each of said first and said second sides between each of said gripping surfaces and said orifice in said top side of said bottle body, wherein said gripping surfaces are spaced apart a distance that is less than the distance that the first and second sides are spaced apart between said shoulder and said orifice, said shoulder acting to stiffen said first and said second sides of said bottle body to resist paneling when the bottle is inverted and the fluid is being dispensed through said orifice.

2. The bottle of claim 1, wherein one of said shoulders extends generally transversely across each of said first and said second sides.

3. The bottle of claim 2, wherein each of said shoulders tapers towards said orifice adjacent said ends of the bottle.

* * * * *

UNITED STATES PATENT AND TRADEMARK OFFICE
Certificate

Patent No. 5,435,451 Patented: July 25, 1995

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: John J. Dyer, Shoreview, MN; and Duncan M. Toll, Wilton, CT.

Signed and Sealed this Seventeenth Day of December 2002.

LEE W. YOUNG
*Supervisory Patent Examiner*
Art Unit 3727